US005529408A

United States Patent [19]

Moriguchi et al.

[11] Patent Number: 5,529,408

[45] Date of Patent: Jun. 25, 1996

[54] THERMAL TRANSFER RECORDING METHOD INCLUDING PREHEATING THERMAL TRANSFER RECORDING MEDIUM

[75] Inventors: Haruhiko Moriguchi; Kazuhiro Nakajima; Hiroshi Sato; Masato Katayama, all of Yokohama, Japan

[73] Assignee: Canon Kabushiki Kaisha, Tokyo, Japan

[21] Appl. No.: 475,417

[22] Filed: Jun. 7, 1995

Related U.S. Application Data

[63] Continuation of Ser. No. 117,640, Sep. 8, 1993, abandoned, which is a continuation of Ser. No. 839,709, Feb. 24, 1992, abandoned, which is a continuation of Ser. No. 488,390, Feb. 23, 1990, abandoned, which is a continuation of Ser. No. 124,058, Nov. 23, 1987, abandoned.

[30] Foreign Application Priority Data

Nov. 26, 1986 [JP] Japan ..... 61-282320

[51] Int. Cl.[6] ..... B41J 2/38

[52] U.S. Cl. ..... 400/120.08; 347/179; 347/187; 400/696

[58] Field of Search ..... 400/120.09, 120.14, 400/120.08, 696; 347/185, 186, 187, 189, 194, 179

[56] References Cited

U.S. PATENT DOCUMENTS

| | | | |
|---|---|---|---|
| 4,370,666 | 1/1983 | Noda et al. | 346/76 PH |
| 4,376,942 | 3/1983 | Toth et al. | 400/120 X |
| 4,384,797 | 5/1983 | Anderson et al. | 400/696 |
| 4,396,308 | 8/1983 | Applegate et al. | 400/696 |
| 4,510,507 | 4/1985 | Ishikawa | 346/76 PH |
| 4,572,687 | 2/1986 | Croley et al. | 400/120 X |
| 4,590,486 | 5/1986 | Yana | 400/120 X |
| 4,591,876 | 5/1986 | Nozaki et al. | 346/76 PH |
| 4,609,926 | 9/1986 | Aviram et al. | 400/120 X |
| 4,621,271 | 11/1986 | Brownstein | 400/120 X |
| 4,636,810 | 1/1987 | Asakura et al. | 346/76 PH |
| 4,641,148 | 2/1987 | Dyer et al. | 400/120 X |
| 4,651,162 | 3/1987 | Nakamura et al. | 400/696 |
| 4,652,154 | 3/1987 | Horiya et al. | 400/120 |
| 4,652,892 | 3/1987 | Tanaka | 400/120 X |

(List continued on next page.)

FOREIGN PATENT DOCUMENTS

| | | | |
|---|---|---|---|
| 0106663 | 4/1984 | European Pat. Off. . | |
| 49-126341 | 12/1974 | Japan . | |
| 53-33158 | 3/1978 | Japan . | |
| 0141650 | 5/1979 | Japan | 400/120 |
| 56-62170 | 5/1981 | Japan . | |

(List continued on next page.)

OTHER PUBLICATIONS

IBM Technical Disclosure Bulletin, "Ribbon Normalization by Preheating", vol. 29 No. 9, Feb. 1987, p. 3965.

M. P. Prater, "Superthreshold Impact Heat Printing", IBM Technical Disclosure Bulletin, Apr. 1959 (vol. 1, No. 6), p. 4.

*Primary Examiner*—David A. Wiecking

*Attorney, Agent, or Firm*—Fitzpatrick, Cella, Harper & Scinto

[57] ABSTRACT

A thermal transfer recording and correction method, in which a thermal transfer ink layer is placed in contact with a transfer-receiving medium and is heated by heat generating elements of a thermal head in a pattern corresponding to a recording signal, is improved by preheating the ink layer. The ink layer, which is characterized by a transfer initiation temperature, is preheated by the thermal head which is heated by a preheating means. When a region of the ink layer is then further heated by the heat generating elements, the temperature of that region has a maximum and a minimum both within a range extending from the transfer initiation temperature to about 40° C. higher than the transfer initiation temperature. Since the maximum and minimum temperatures are within a suppressed temperature range, an erroneous image can be more easily peeled off the transfer-receiving medium.

4 Claims, 12 Drawing Sheets

U.S. PATENT DOCUMENTS

| | | | |
|---|---|---|---|
| 4,654,674 | 3/1987 | Hibino et al. | 400/696 X |
| 4,675,700 | 6/1987 | Nagira et al. | 346/76 PH |
| 4,675,701 | 6/1987 | Chu et al. | 400/120 X |
| 4,739,338 | 4/1988 | Tanaka et al. | 400/120 X |
| 4,762,431 | 8/1988 | Denny et al. | 400/120 |
| 4,786,195 | 11/1988 | Hibino et al. | 400/696 |
| 4,797,837 | 1/1989 | Brooks | 400/120 |

FOREIGN PATENT DOCUMENTS

| | | | |
|---|---|---|---|
| 56-62171 | 5/1981 | Japan . | |
| 0131080 | 8/1983 | Japan | 400/120 |
| 0076268 | 5/1984 | Japan | 400/120 |
| 59-159391 | 9/1984 | Japan . | |
| 59-164160 | 9/1984 | Japan | 347/186 |
| 0169876 | 9/1984 | Japan | 400/120 |
| 0156787 | 9/1984 | Japan | 400/120 |
| 0156768 | 9/1984 | Japan | 400/120 |
| 0227468 | 12/1984 | Japan | 400/120 |
| 60-54890 | 3/1985 | Japan . | |
| 0067177 | 4/1985 | Japan | 400/120 |
| 0097884 | 5/1985 | Japan | 400/120 |
| 60-101082 | 6/1985 | Japan . | |
| 0127186 | 7/1985 | Japan | 400/120 |
| 0257260 | 12/1985 | Japan | 400/120 |
| 0020761 | 1/1986 | Japan | 400/120 |
| 0244579 | 10/1986 | Japan | 400/120 |
| 0252184 | 11/1986 | Japan | 400/120 |
| 0290070 | 12/1986 | Japan | 400/120 |
| 0286170 | 12/1986 | Japan | 400/120 |
| 0290080 | 12/1986 | Japan | 400/120 |

THERMAL TRANSFER RECORDING METHOD INCLUDING PREHEATING THERMAL TRANSFER RECORDING MEDIUM

This application is continuation of application Ser. No. 08/117,640 filed Sep. 8, 1993, which is a continuation of application Ser. No. 07/839,709 filed Feb. 24, 1992, which is a continuation of application Ser. No. 07/488,390 filed Feb. 23, 1990, which is a continuation of application Ser. No. 07/124,058 filed Nov. 23, 1987 all now abandoned.

FIELD OF THE INVENTION AND RELATED ART

The present invention relates to a thermal transfer recording method and a thermal transfer recording medium for use in printers, facsimile recorders, word processors, etc.

In the conventional thermal transfer recording method, the image quality of the recorded images is remarkably affected by surface properties of recording paper.

Particularly, a so-called rough paper having a poor surface smoothness in terms of a Bekk smoothness of about 10 sec or less provides a recorded image with poor image qualities, such as low density and poor edge sharpness.

Further, when it is intended to correct a recorded image formed by the conventional thermal transfer recording method, the recorded image is difficult to remove perfectly by peeling, so the correction thereof by peeling or lifting-off is difficult.

The Quiet Writer proposed by IBM Inc. (e.g., by U.S. Pat. No. 4,384,797 and U.S. Pat. No. 4,396,308) uses a non-impact type recording method to solve the two problems discussed above. The Quiet Writer, however, has adopted a current-conduction transfer system wherein a current is passed through an ink ribbon to generate heat for transfer, so that an expendable ink ribbon becomes complicated in structure and expensive because of increases in material cost and production cost.

On the other hand, there have been proposed a thermal head which is constructed to be heated uniformly as a bias so as to supplement heat-generation of a heat-generating element of the thermal head, and a thermal printer using such a thermal head. For example, in Japanese Laid-Open Patent Application No. 126341/1974, and Japanese Laid-Open Patent Applications Nos. 62170/1981 and 62171/1981 proposed by our research group, a thermal head is uniformly bias-heated.

In all of these prior art references the bias heating is effected to supplement heat generation of heating elements in the thermal head so that a particular heat-generating element supplied with an electric pulse will quickly reach a prescribed temperature to provide an increased printing speed. Accordingly, in any of the methods of the above prior art references, a transfer medium is not intended or described to be supplied with heat before it is heated in a pattern with heat-generating elements of the thermal head. Rather, preheating of a transfer recording medium before it is heated by heat-generating elements of the thermal head causes excessive transfer, thus resulting in an undesirable mode of operation. For example, in Japanese Laid-Open Patent Application No. 62171/1981, a spacer is disposed between the transfer recording medium and the thermal head in order to prevent preheating of the transfer medium.

SUMMARY OF THE INVENTION

A principal object of the present invention is to provide a thermal transfer recording method which is a non-impact recording method capable of providing high-quality images on rough paper and also stably providing recorded images correctable by lifting-off.

According to the present invention, there is provided a thermal transfer recording method, comprising providing a thermal transfer recording medium comprising a thermal transfer ink layer on a support, providing a thermal head having heat-generating elements, disposing the thermal transfer recording medium in contact with a transfer-receiving medium so that the thermal transfer ink layer contacts the transfer-receiving medium, energizing the heat-generating elements corresponding to a given recording image signal to heat the thermal transfer ink layer of the thermal transfer recording medium in a pattern, and separating the thermal transfer recording medium from the transfer-receiving medium to leave a recorded image of the heated thermal transfer ink layer on the transfer-receiving medium corresponding to the given recording image signal; characterized in that the thermal transfer ink layer is supplied with a heat energy non-selectively or non-imagewise so as to assume a temperature of 3°–60° C. in the absence of energization of the heat-generating elements, and the heat-generating elements are energized while the heat energy is applied. A part of the recorded image may be removed for correction, as desired, by bonding a correction tape thereto and peeling off the tape.

These and other objects, features and advantages of the present invention will become more apparent upon a consideration of the following description of the preferred embodiments of the present invention taken in conjunction with the accompanying drawings, wherein like parts are denoted by like reference numerals. In the description appearing hereinafter, "part(s)" and "%" used for describing quantities are by weight unless otherwise noted specifically.

DESCRIPTION OF PREFERRED EMBODIMENTS

An embodiment of the thermal transfer recording method of the present invention is explained with reference to FIG. 1 which is a top plan view of an apparatus for practicing the method, and FIG. 2 which is a partial enlarged view of FIG. 1.

Figure 2:
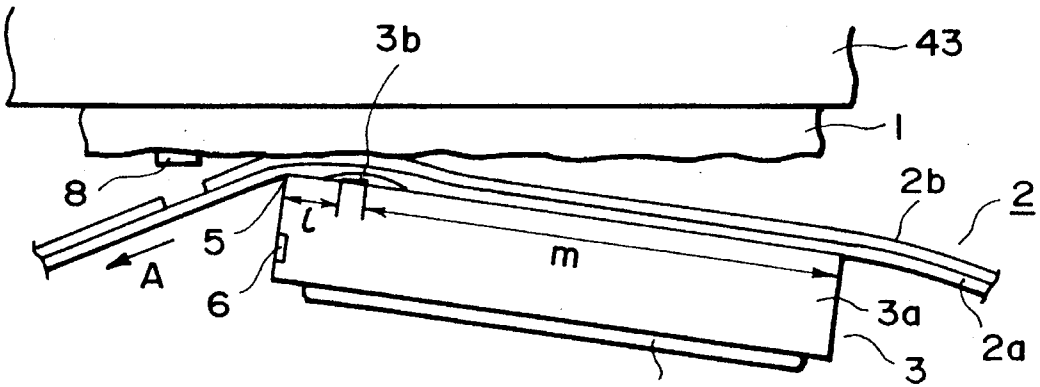
FIG. 2 is an enlarged view of a part around the thermal head shown in FIG. 1.

Facing a record paper 1 as a transfer-receiving medium, there is disposed a thermal transfer recording medium 2 which comprises a support 2*a* and a thermal transfer ink layer 2*b* formed thereon as shown in FIG. 2.

When the transfer recording medium 2 is heated to above a transfer-initiation temperature $T_1$, the thermal transfer ink layer 2*b* is melted or softened to have an adhesiveness to the surface of the record paper 1. Thereafter, the record paper 1 and the transfer recording medium 2 are separated from each other at a peeling position, whereby a heated portion of the thermal transfer ink layer 2*b* is transferred onto the record paper 1 to form a recorded image 8 on the record paper 1. For imagewise heating of the transfer recording medium 2, a thermal head 3 comprising heat-generating elements (or heating elements) 3*b* disposed on a substrate 3*a*. The thermal head 3 as a whole is heated by a heater 7, and the temperature of the substrate 3*a* of the thermal head 3 is detected by a temperature detecting element 6. Both ends of the thermal transfer recording medium 2 are wound about a feed roller 41 and a take-up roller 42, and the transfer recording medium 2 is gradually fed in the direction of an arrow A.

The thermal head 3 is affixed to a carriage 46 and is caused to push a back platen 43 at a prescribed pressure while sandwiching the record paper 1 and the thermal transfer recording medium 2. The carriage 46 is moved along a guide rail 45 in the direction of an arrow B. Along with the movement, recording is effected on the record paper 1 by the thermal head 3.

Prior to the recording operation, the heater 7 is energized, and the thermal transfer ink layer 2*b* is controlled at a prescribed temperature $T_0$ while monitoring the temperature of the substrate 3*a* by the temperature detecting element 6. The temperature $T_0$ is set to a temperature in the range of 35° C. to 60° C., preferably 40° C. to 50° C., as measured at a position of the transfer recording medium 2 contacting the heating elements 3*b* but without energizing the heating elements 3*b*.

There can be a case where the thermal head 3 as a whole does not assume a uniform temperature and the temperature detected by the detecting element 6 is different from the temperature $T_0$ depending on the position of the heater 7 or the detecting element 6 or the mode of operation. The heater 7 is controlled while taking the difference into consideration. After the thermal transfer ink layer 2*b* is stabilized at the prescribed temperature $T_0$, the thermal transfer recording medium 2 is conveyed while energizing the heat-generating elements 3*b* depending on image signals similarly as in the conventional thermal transfer recording method, whereby a thermally transferred recorded image 8 may be formed. The heater 7 used may be a resistance heat-generating member such as nickel-chromium wire or may be a posistor. The temperature detecting element 6 may also be a thermistor thermo-couple, etc.

Figure 5:
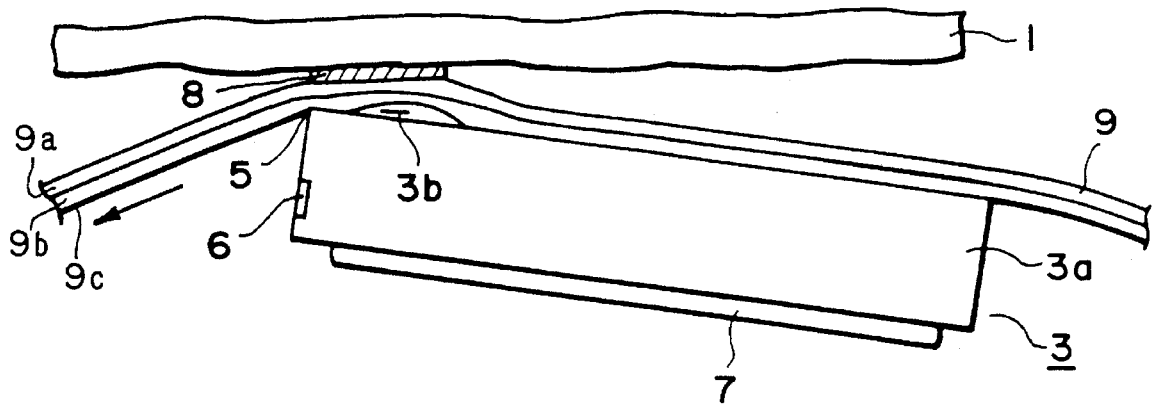
FIG. 5 is a plan view illustrating a mode of peeling an error image by using a correction tape.

The recorded image 8 thus formed by the method according to the present invention may be one which has sharp and clear edges and which can be corrected by peeling with an adhesive tape 9C see FIG. 5), etc., i.e., lifting-off, with respect to a portion thereof requiring a correction. These effects are particularly pronounced where a transfer recording medium 2 having a transfer ink layer 2*b* containing a resin component in a large proportion is used, and the method can be sufficiently applied when the transfer recording medium 2 has a low surface smoothness.

While it will be described in detail hereinafter, the transfer ink layer 2*b* of a transfer recording medium 2 suitable for the present invention may be formed by using a resin component, such as ethylene-acrylic acid-type copolymer, oxidized polyethylene, ethylene-vinyl acetate-type copolymer, vinyl acetate-olefin-type copolymer, acrylic resin, urethane-type resin, and polyamide-type resin as a predominant component, i.e., 50% or more, preferably 70% or more, of the heat-fusible material so as to provide desired characteristics with respect to melt-viscosity, temperature dependency of film strength, change with elapse of time after heating by a thermal head 3, and transfer-initiation temperature as will be described hereinafter.

An example of a correction mode is explained with reference to FIG. 5. An image 8 to be corrected is peeled from a record paper 1 by using a correction (or adhesive) tape 9 which develops adhesiveness then heated. The correction tape 9 may suitably be disposed above or below the transfer recording medium 2, and the transfer recording medium 2 and the correction tape 9 may be moved upward or downward depending on whether the transfer recording medium 2 or the correction tape 9 is driven. More specifically, heating elements 3*b* are heated in the same manner as in the recording operation described above, and then the adhesive layer 9*a* of the correction tape 9 and the image 8 are bonded to each other, followed by separation to peel the image 8. At this time, the heater 7 need not be operated.

In the above-described embodiment, the substrate 3*a* of a thermal head 3 is provided with a heater 7 to heat the entirety of the substrate 3*a* whereby a heat energy is applied to the thermal transfer recording medium 2. It is, however, also possible to provide the back platen 43 with a heater therein so as to heat the back platen 43 to a prescribed temperature or higher whereby a heat energy is imparted to the transfer recording medium 2.

Figure 1:
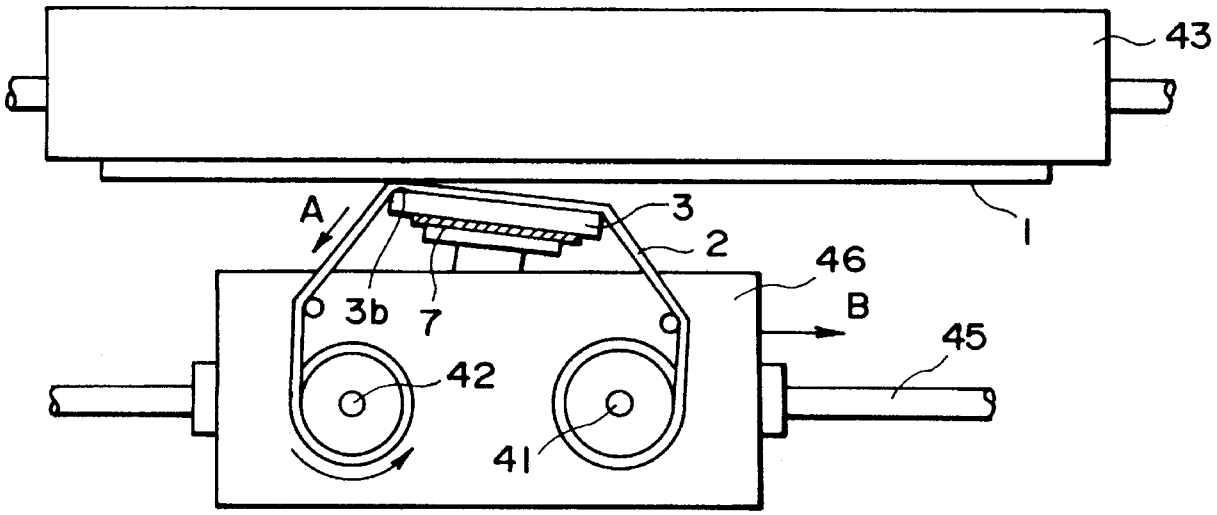
FIG. 1 is a top plan view of an apparatus for practicing the method according to the present invention.

In the above described embodiment shown in FIGS. 1 and 2, a section m and a section 1 are provided before and after the heating elements 3*b*, and the transfer recording medium 2 is heated while contacting these sections m and l of the thermal head 3. However, in the case where the transfer recording medium 2 is very slowly moved or can be stopped for a moment, these sections (l and m) need not be provided.

According to the present invention, a thermal transfer recording medium 2 is heated to a temperature of 35°–60° C. as measured at a position contacting the heating elements 3*b* and without energizing the heating elements 3*b*, and thermal transfer recording is effected, while such a heated state is maintained, to provide clear recorded images 8 even when the recording paper is rough, which can be corrected without difficulty. The functioning mechanism will be supplemented hereinbelow.

First, the transfer initiation temperature $T_1$ may be measured in the following manner.

In the system shown in FIG. 2, the thermal head 3 can be replaced by a heating block not shown, and recording is carried out while changing the temperature of the heating block and under a pressing force of 400 g/cm$^2$. The temperature of the heating block at which a visible transferred image 8 is initially formed is determined as $T_1$.

The quality of a recorded image 8 and the correctability of the image 8 by lifting-off are remarkably affected by the temperature of the thermal transfer ink layer 2*b* before it is heated by heating elements 3*b*, and the temperature of the ink layer 2*b* after the completion of the heating by the heating elements 3*b* up to the separation.

Figure 3A:
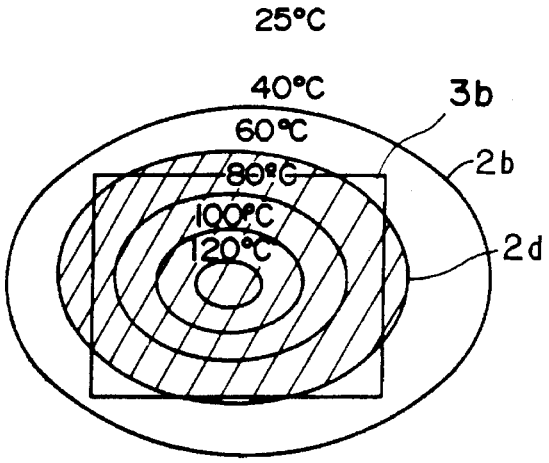
FIGS. 3A and 3B each illustrate an example of temperature distribution on a thermal transfer ink layer.
Figure 3B:
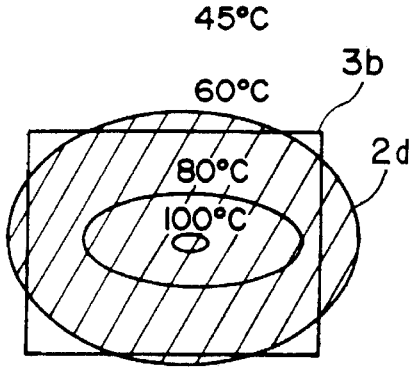

FIGS. 3A and 3B respectively show a temperature distribution of a thermal transfer ink layer 2*b* when it is heated by one heating element 3*b*. FIG. 3A shows a case where the temperature of the ink layer 2*b* before the heating by the heating element 3*b* is room temperature (25° C.), and FIG. 3B shows a case where the ink layer 2*b* is heated to 45° C. before it is heated by the heating element 3*b*. The thermal transfer ink layer 2*b* has a transfer initiation temperature of 60° C., so that the hatched region 2*d* thereof is transferred. In the cases of FIGS. 3A and 3B, the energies applied to the heating element 3*b* have been regulated so that substantially the same area is transferred in both cases.

As a result, in the case of FIG. 3A where no heat energy is applied to the ink layer 2*b* by the heating element 3*b*, the highest temperature in the transfer region reaches as high as 120° C., thereby to result in a large difference between the highest temperature and the lowest temperature. On the other hand, in the case of FIG. 3B where the ink layer 2*b* is heated to 45° C. before heating by the heating element 3*b*, the highest temperature in the transfer region 2*b* is suppressed to 100° C. which is lower than in the case of FIG. 3A. In the case where the transfer region has a large difference between the highest temperature and the lowest temperature as shown in FIG. 3A, the quality of the resultant recorded image 8 deteriorates, particularly when the paper 1 is rough.

More specifically, if the difference between the highest temperature and the lowest temperature in the transfer region 2*d* is too large, the melt viscosity of the transfer region 2*d* becomes excessively low at the high temperature portion to cause a large degree of permeation of the record paper 1 surface and results in an image 8 of a low density. Further, on a record paper 1 with large surface unevenness, i.e., a rough paper 1, there results a transferred portion and a non-transferred portion because the melted ink flows into a concavity, whereby the recorded image 8 is caused to have a poor image quality. Further too large a degree of permeation of the thermal transfer ink into paper texture results in an image of poor correctability, i.e., one which is difficult to correct.

As described above, by preheating the thermal transfer ink layer 2*b* to a temperature of 35°–60° C. prior to thermal transfer recording by energizing a heating element 3*b*, it is possible to decrease the temperature difference in the transfer region 2*d* of the ink layer 2*b*, whereby the quality and correctability of the recorded image 8 can be increased.

Next, there will be described the temperature change of the thermal transfer ink after the thermal transfer ink layer 2*b* is heated and until the separation.

Figure 4A:
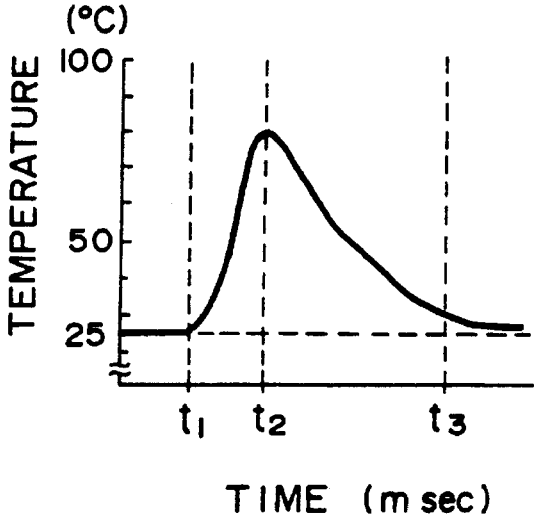
FIGS. 4A and 4B are graphs each showing a temperature change of a thermal transfer ink layer.
Figure 4B:
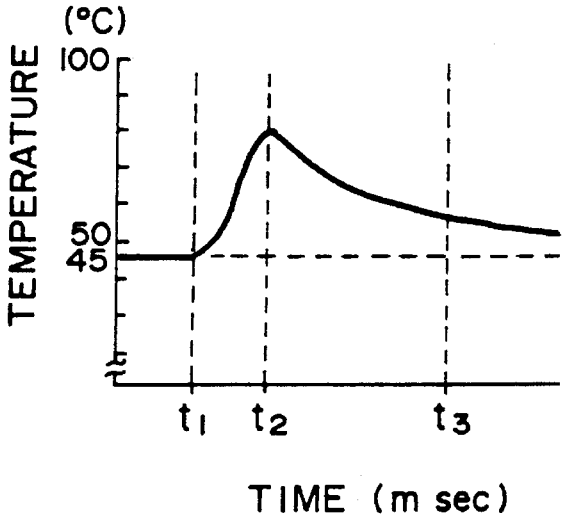

FIGS. 4A and 4B respectively show a temperature change of a thermal transfer ink layer 2*b* after it is heated up to 80° C. by a heating element 3*b*. Referring to these figures, heating is effected for a period of $t_1$ to $t_2$ and terminated at time $t_2$, and the thermal transfer recording medium 2 is separated from the record paper 1 at time $t_3$. When FIGS. 4A and 4B are compared with FIG. 2, a period in which the transfer recording medium 2 passed along the heating element 3*b* in FIG. 2 corresponds to the heating period of $t_1$ to $t_2$ in FIGS. 4A and 4B. Further, the period in which the transfer recording medium 2 passes through the section 1 corresponds to the period $t_2$ to $t_3$, and the transfer recording medium 2 reaches the position of separation 5 at time $t_3$.

FIG. 4A shows a case where heat energy is not imparted to the thermal transfer ink layer 2*b* except from the heating elements 3*b*, while FIG. 4B shows a case where heat energy is imparted to heat the thermal transfer ink layer 2*b* to 45° C. before the heating by the heating element 3*b* and the same level of heat energy is continually applied during and even after the heating by the heating element 3*b*. As shown in FIG. 4B, the temperature of the thermal transfer ink layer 2*b* gently decreases after passing the heating element 3*b*, whereby there results a difference in temperature at the peeling position (time $t_3$) between the cases of FIGS. 4A and 4B.

As a result, between the cases of FIGS. 4A and 4B, there results a difference in properties, such as hardness and strength, of the thermal transfer ink layer 2*b* at the peeling position, and this difference leads to a difference in image quality.

With respect to the quality of a recorded image 8, a larger difference in strength between a transferred portion and a non-transferred portion is preferred because it provides a sharper cutting at the boundary. In a case where the temperature of a thermal transfer ink layer 2*b* gently decreases after passing a heating element 3*b* as shown in FIG. 4B, a large difference in strength is attained between the transferred portion and the non-transferred portion at the peeling position (at time $t_3$). For this reason, the case of FIG. 4B according to the present invention provides a better image quality with a better edge sharpness.

With respect to the amount of heat energy applied to the thermal transfer ink layer 2*b* in addition to the heating by the heating element 3*b*, too low a temperature of the thermal transfer ink layer 2*b* before the heating by the heating element 3*b* is not desirable because the temperature of the thermal transfer ink layer 2*b* is affected by the environmental temperature. Further, too high a temperature of the thermal transfer ink layer 2*b* before the heating by the heating element 3*b* is not desirable because it leads to unwanted transfer.

The period from the completion of the heating by the heating element 3*b* up to the separation of the transfer recording medium 2 from the record paper 1, i.e., period of ($t_3$–$t_2$) in FIGS. 4A and 4B, may preferably be 0.2–80 msec, particularly 0.5–30 msec, from a practical viewpoint.

Now, an explanation is made with respect to a record paper 1 suitably used in the method of the present invention.

Before a recorded image 8 is formed on a record paper 1 (transfer-receiving medium), a thermal transfer ink causes phase transitions of solid state →melted state→softened state. Herein, the softened state refers to a somewhat softened state not yet restored to the original solid state. In the recording method according to the present invention, the temperature of the thermal transfer ink layer 2*b* is controlled to change as shown in FIG. 4B, in order to provide a recorded image 8 with a uniform density and a good edge sharpness even on a record paper 1, which image 8 can be corrected by lifting-off if necessary. At this time, it is required for the thermal transfer ink layer 2*b* to have appropriate viscosity and film strength so as not to excessively permeate into the record page 1 at time $t_2$ and to have an appropriate difference in film strength between the heated portion and the non-heated portion at time $t_3$. Further, in order that the transfer of the thermal transfer ink layer 2b to the record paper 1 is ensured, the thermal transfer ink layer 2b is required to contain a component which develops an adhesiveness to the record paper 1 on heating and a component which decreases an adhesiveness to the support 2a on heating.

Figure 6:
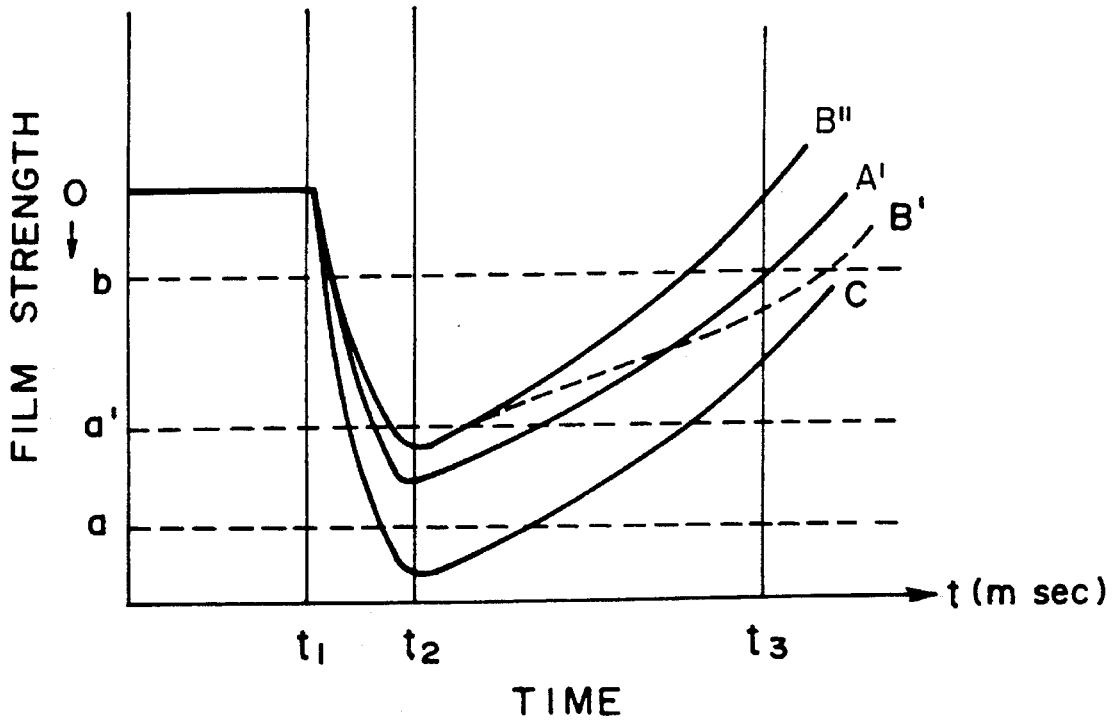
FIG. 6 is a graph showing a change in film strength of a transfer medium according to the present invention.

From the above viewpoints, it is preferred that a transfer recording medium 2 suitably used in the present invention has a thermal transfer ink layer 2b such that a heated portion thereof causes a change in film strength as represented by a curve A' shown in FIG. 6 when the transfer recording medium 2 is heated to a range of 35°–60° C. and, under this state, subjected to thermal transfer recording by means of a thermal head 3. FIG. 6 is a graph showing qualitatively how the film strength of a heated portion of the thermal transfer ink layer 2b changes with elapse of time. In FIG. 6, $t_1$, $t_2$ and $t_3$ correspond to $t_1$, $t_2$ and $t_3$, respectively, in FIGS. 4A and 4B.

More specifically, in the present invention, it is preferred that the film strength of the thermal transfer ink layer 2b at time $t_3$ is not restored to the value before the heating by the heating element 3b but assumes a value at a prescribed value (b) or below as shown in FIG. 6. If the film strength at time $t_3$ is larger than the prescribed value, a clear difference in film property is not attained between the heated portion and the non-heated portion, so that cutting at the boundary does not readily occur.

It is also preferred that the film strength of the thermal transfer ink layer 2b at time $t_2$ is within a prescribed range (a'–a). If the film strength is larger than the prescribed range, the melt viscosity becomes high resulting in a low adhesiveness to the record paper 1 and a poor transfer characteristic. On the other hand, if the film strength is smaller than the prescribed range, the melt viscosity becomes low resulting in excessive permeation of the thermal transfer ink into the record paper 1 and a poor correctability. The prescribed value (b) and the prescribed range (a'–a) vary depending on the quality of the record paper 1.

The curve B" in FIG. 6 represents a film strength characteristic that the film strength is within the prescribed range (a'–a) at time $t_2$ but is larger than the prescribed value (b) at time $t_3$, thus resulting in a recorded image 8 with poor edge sharpness.

The curve C represents a characteristic that the film strength at time $t_3$ is below the prescribed value (b) but is lower than the prescribed range (a'–a) at time $t_2$, thus resulting in a record image 8 with excessive ink permeation into the record paper 1.

Further, a transfer recording medium 2 showing a film strength characteristic as represented by the curve B" when subjected to recording without being uniformly heated to 35°–60° C., can be converted to show a characteristic as represented by a curve B' when it is used according to the recording method of the present invention, thus resulting in a recorded image 8 excellent in both image quality and correctability.

As the support 2a of the transfer recording medium 2 to be used in the present invention, it is possible to use a conventional film or paper as it is, inclusive of films of a plastic having a relatively good heat resistance, such as polyester, polycarbonate, triacetyl cellulose, polyphenylene sulfide, polyamide, and polyimide; cellophane, parchment paper and capacitor paper. The thickness of the support 2a may preferably be about 1 to 15 μm when a thermal head 3 is used as a heat source for thermal transfer recording. Further, in the case where a thermal head 3 is used, it is possible to improve the heat resistance of the support 2a or use a support material which could not be used heretofore, by disposing, on the surface of support 2a contacting the thermal head 3, a heat-resistance protective layer 9C of, e.g., silicone resin, fluorine-containing resin, polyimide resin, epoxy resin, phenoic resin, melamine resin, acrylic resin, and nitrocellulose.

The thermal transfer ink layer 2b may be constituted so as to satisfy the above-mentioned film strength characteristic by appropriately combining materials selected from the group comprising: waxes, such as carnauba wax, paraffin wax, Sasol wax, microcrystalline wax, and castor wax; higher fatty acids and their derivatives inclusive of metal salts and esters, such as stearic acid, palmitic acid, lauric acid, aluminum stearate, lead stearate, barium stearate, zinc stearate, zinc palmitate, methyl hydroxystearate, and glycerol monohydroxystearate; polyamide resins, polyester resins, epoxy resins, polyurethane resins, acrylic resins (such as polymethyl methacrylate, polyacrylamide), vinyl acetate resins, vinyl resins represented by polyvinylpyrrolidone, polyvinyl chloride resins (such as vinyl chloride-vinylidene chloride copolymer, vinyl chloride-vinyl acetate copolymer, cellulose resins (such as methyl cellulose, ethyl cellulose, carboxycellulose), polyvinyl alcohol resins (such as polyvinyl alcohol, partially saponified polyvinyl alcohol), petroleum resins, rosin derivatives, coumarone-indene resin, terpene resin, novolak-type phenol resin, polystyrene resins, polyolefin resins (such as polyethylene, polypropylene, polybutene, ethylene-vinyl acetate copolymer, oxidized polyolefin), polyvinyl ether resins, polyethylene glycol resins, elastomers, natural rubber, styrene-butadiene rubber, methyl methacrylate-butadiene, acrylonitrile-butadiene rubber, and isoprene rubber.

The thermal transfer ink layer 2b may have any layer structure but may preferably comprise plural layers in view of adhesion to the record paper 1 and releasability from the support 2a when heated by the thermal head 3. It is particularly preferred to have a three-layer structure (in a sense including a case of more than three layers) including a layer containing a component which reduces adhesiveness to the support 2a on heating and a layer containing a component which develops adhesiveness to the record paper 1 on heating.

The thermal transfer ink layer 2b can have a three-layer structure (not shown) including a first ink layer, a second ink layer and a third ink layer from the support side, the first ink layer is caused to have a release function whereby the adhesiveness to the support 2a is decreased to promote the separation of the thermal transfer ink from the transfer recording medium 2. For this reason, it is preferred that the first ink layer comprises as its predominant component (i.e. 50% or more of the total heat fusible material) a non-polar heat-fusible material, such as wax, low-molecular weight oxidized polyethylene or a polyolefin such as polypropylene. It is also possible to add a polar material such as acrylic resin and vinyl acetate resin.

The second ink layer fulfills a coloring function and also functions to control the film strength immediately after the heat application and the change with time thereafter of the film strength. The third ink layer fulfills a function of controlling the adhesiveness of the heated portion of the paper 1 and also functions to control the strength immediately after the heat application and the change with time thereafter of the film strength similarly to the second ink layer.

The control of the film strength immediately after the heat application may be accomplished by appropriately selecting the materials for the respective ink layers from the group of materials mentioned above and adjusting the molecular weight and cohesion forces of such materials. Further, the change in film strength with elapse of time after the heat application may be controlled by appropriately changing proportions, crystallinity, cohesion force and molecular weight of materials selected for the respective layers from the above group of materials. It is particularly preferred to use a material having a high crystallinity and utilize a time delay until recrystallization. It is particularly preferred to use as a predominant component, i.e., 50% or more, more preferably 70% or more, in the second and third ink layers a resin or polymer component, preferably consisting predominantly of olefin, such as low-molecular weight oxidized polyethylene, ethylene-vinyl acetate copolymer, vinyl acetate-ethylene copolymer, ethylene-acrylic acid copolymer, ethylene-methacrylic acid copolymer, ethylene-acrylic acid, and ester copolymer, or polyamide, polyester, etc.

As described above, the film strength of the ink layer 2b of a transfer recording medium 2 used in the recording method according to the present invention may preferably show a change with time as represented by the curve A' or B' shown in FIG. 6. In order to evaluate the change with time in film strength, a penetrometer explained in detail hereinbelow may be used.

Figure 7A:
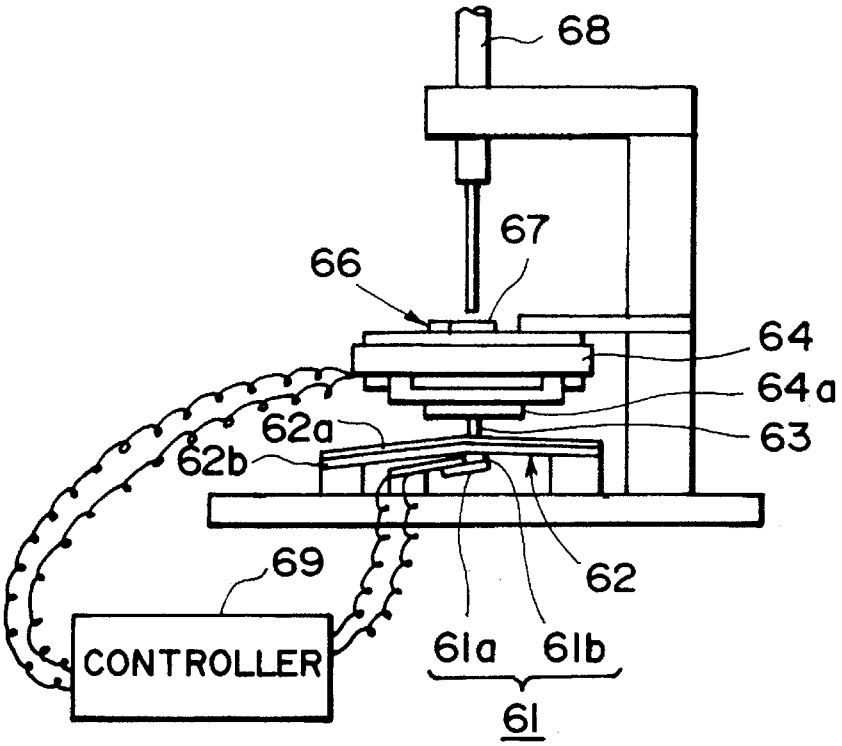
FIG. 7A is a front view of a penetrometer.

FIG. 7A is a front view of such a penetrometer. In order to know a change with time in a very short period, a thermal head 61 provided with a heating element 61b and a substrate 61a is used. A sample transfer medium 62 to be measured is set to be pushed against the heating element 61b by a tension. A contact needle 63 is one made of stainless steel having a tip of 80 μ-diameter and is disposed at a position capable of pressing the thermal transfer ink layer 62a, which is supported by a base film 62b.

The contact needle 63 is affixed to a plunger 64 which is a moving part of a voice coil actuator 64a available from Foster Denki K. K. and presses the sample with a prescribed force by driving the voice coil actuator 64a. Further, a flat spring 66 is affixed so that the tip of the needle 63 is stably positioned at the surface of the sample transfer medium 62 when the driving current to the voice coil actuator 64a is adjusted. At the opposite end of the plunger 64, a mirror reflection plate 67 is fixed, and the vertical displacement thereof is measured by a micro-displacement meter 68 M 8500 or M 8300 available from Photonics K. K. The measured value corresponds to the movement of the needle 63. A controller 69 controls the thermal head 61 and the voice coil actuator 64a.

Figure 7B:
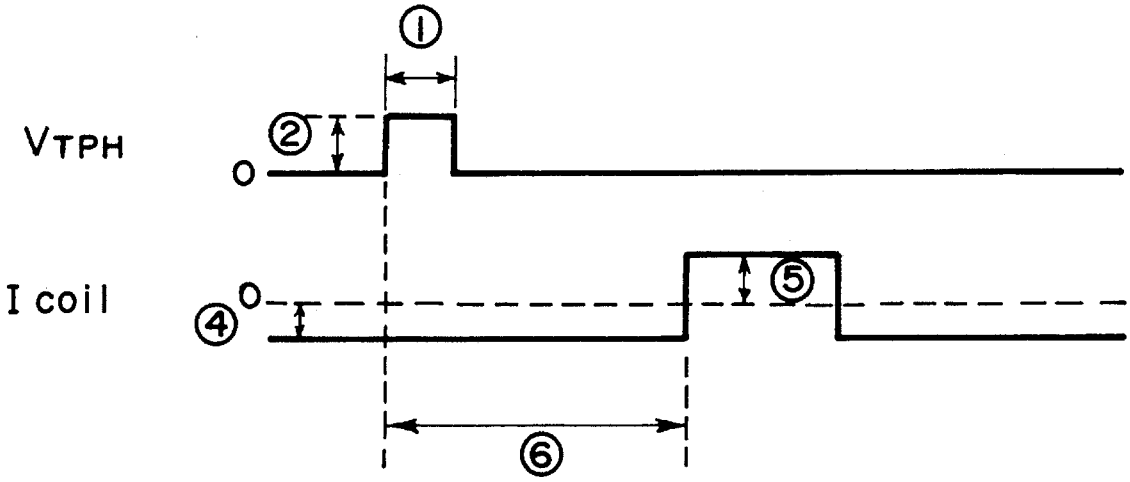
FIG. 7B is a time chart showing a heat-generating element-driving pulse and a coil-driving current pulse applied to the penetrometer.

FIG. 7B is a time chart showing a relationship between a driving voltage pulse $V_{TPH}$ supplied to the heating element 61b of the thermal head 61 and a driving current pulse $I_{coil}$ supplied to the voice coil actuator 64a. The pulse height ② and pulse duration ① of the driving pulse $V_{TPH}$ are adjusted depending on heating conditions of the sample transfer medium 62. Generally, the pulse height ② may suitably be 10–17 V, and the pulse duration ① may suitably be 0.5–2.0 msec. More specifically, in the case where a sample transfer medium 62 of 5–10 μin thickness is heated to 100°–120° C., a voltage pulse with a height of 15 and a duration of 1 msec, for example, may suitably be used.

Next, a procedure of measurement will be explained.

(A) An initial value ④ (in FIG. 7B) of the driving current supplied to the voice coil is adjusted to a value such that the needle 63 contacts the sample surface at a light pressure in equilibrium with loads such as the flat spring 66, plunger 64 and needle 63 as described above.

(B) A current pulse ⑤ for driving the voice coil actuator 64a with a sign opposite to that of the initial current ④ is supplied to measure a displacement x of the needle 63 corresponding to the penetration of the sample transfer medium 62 under no heating. The pulse duration may be about 100 msec.

(C) The current ④ is enlarged to have the needle 63 be apart from the sample transfer medium 62 and the sample transfer medium 62 is shifted.

(D) Step (A) is repeated.

(E) Under the above conditions, a voltage pulse for driving the heating element 61b is applied to the thermal head 61, and at the trailing end of the voltage pulse, a current pulse ⑤ for driving the coil is applied, thereby to measure a displacement y of the needle 63 corresponding to a penetration of the sample transfer medium 62 under heating.

(F) The steps (A)–(E) are repeated to determine a coil-driving current pulse ⑤ providing the maximum of $|y-x|$.

Figure 7C:
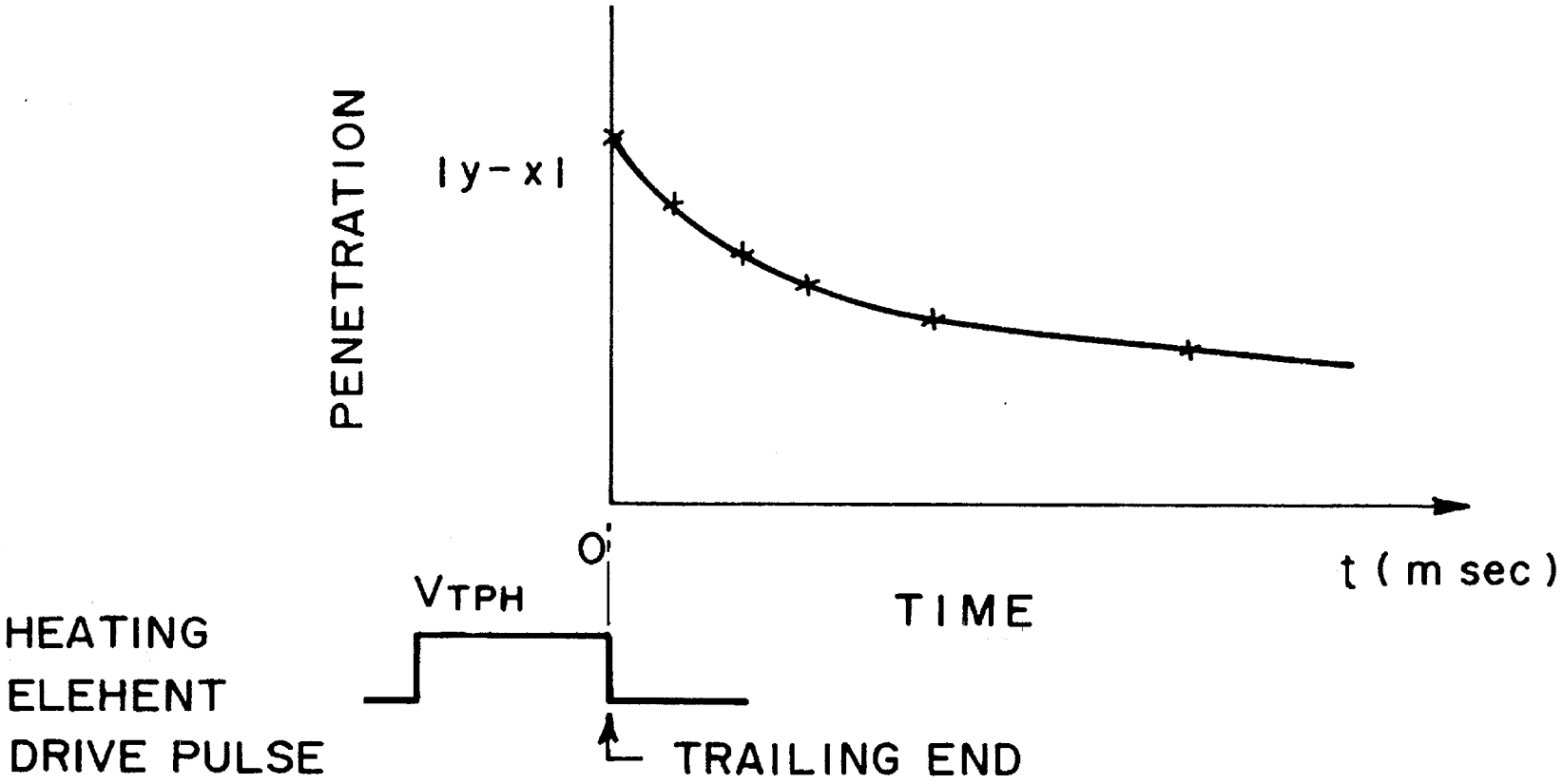
FIG. 7C and FIG. 8 are graphs showing the results of measurement by use of the penetrometer shown in FIG. 7A.

(G) By repeating the above procedure while changing the time ⑥ for applying the coil-driving current pulse ⑤, whereby a relation between the penetration $|y-x|$ and the time ⑥ (or time after the termination of the heating element-driving pulse) as shown in FIG. 7C is obtained. In this way, the change with elapse of time of penetration in terms of $|y-x|$ as defined above may be measured.

Figure 8:
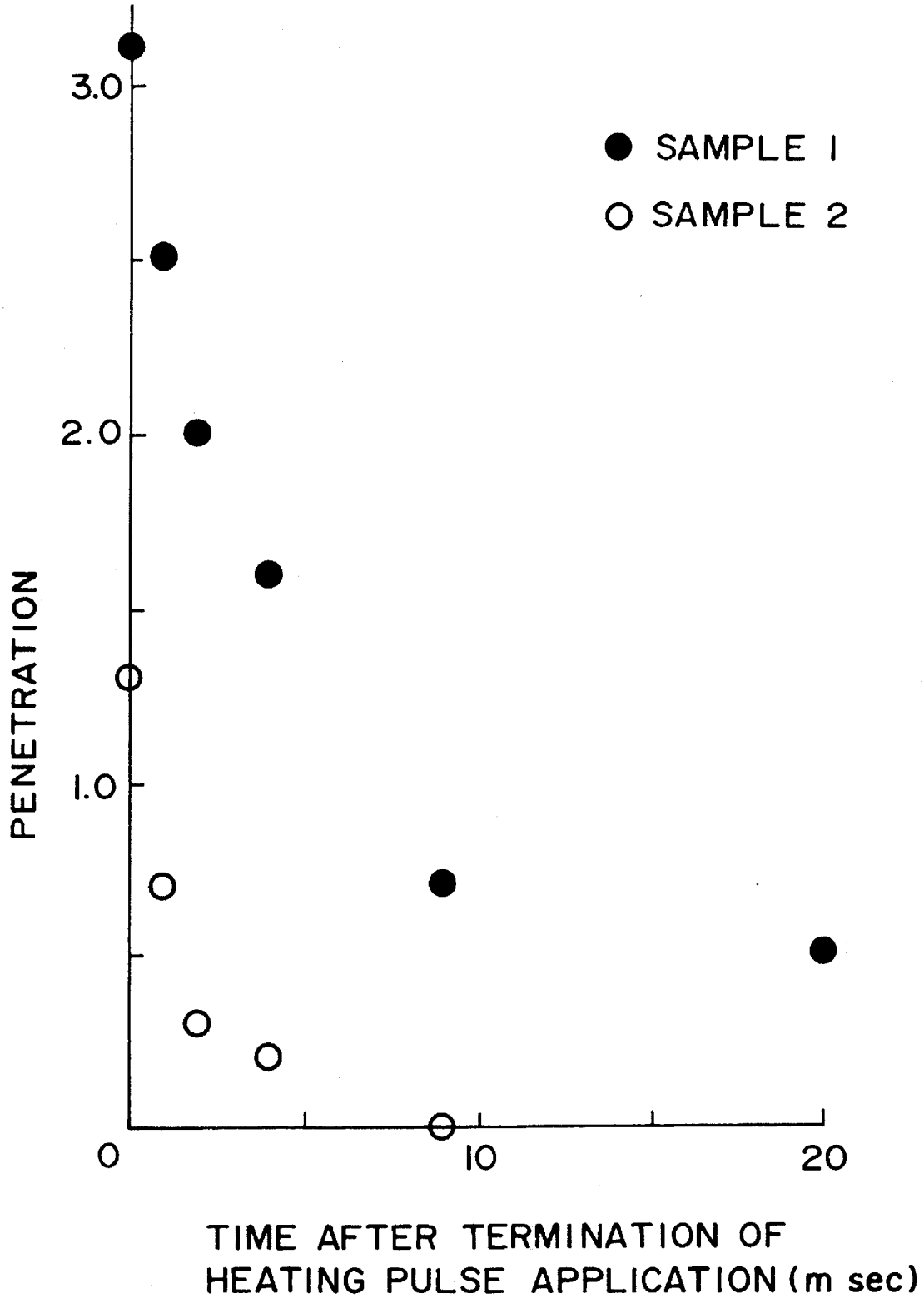

FIG. 8 shows specific examples of results of the above measurement. The dots denoted by SAMPLE 1 represent a change of penetration with time after heating with respect to a suitable ink material for a transfer recording medium 62 according to the present invention. The material retains a small film strength represented by a large penetration as shown in FIG. 8. On the other hand, the dots denoted by SAMPLE 2 represent a change of penetration with time after heating of a material which is not suitable. The material shows a penetration which is smaller than that of SAMPLE 1 already at a time of 2 msec after the heating and reaches a penetration which is restored to the value before the heating. More specifically, SAMPLE 1 was obtained by coating a 6 μ-thick base film of aramid resin with an emulsion of ethylene-vinyl acetate copolymer (melt index: 15, vinyl acetate content: 28%) in a dry thickness of about 9 μ. SAMPLE 2 was obtained by coating the same aramid resin base film with an emulsion of vinyl acetate-ethylene copolymer (vinyl acetate content: 86%) in a dry thickness of about 6 μ.

The thermal transfer ink layer 662a of a transfer recording medium 62 for use in the present invention contains a colorant which may be one or more of known dyes or pigments such as carbon black, Nigrosin dyes, lamp black, Sudan Black SM, Fast Yellow G, Benzidine Yellow, Pigment Yellow, Indo Fast Orange, Irgadine Red, Paranitroaniline Red, Toluidine Red, Carmine FB, Permanent Bordeaux FRR, Pigment Orange R, Lithol Red 2G, Lake Red C, Rhodamine FB, Rhodamine B Lake, Methyl Violet B Lake, Phthalocyanine Blue, Pigment Blue, Brilliant Green B, Phthalocyanine Green, Oil Yellow GG, Zapon Fast Yellow CGG, Kayaset Y963, Kayaset TG, Smiplast Yellow GG, Zapon Fast Orange RR, Oil Scarlet, Smiplast Orange G, Orasol Brown G, Zapon Fast Scarlet CG, Aizen Spiron Red BEH, Oil Pink OP, Victoria Blue F4R, Fastgen Blue 5007, Sudan Blue, and Oil Peacock Blue.

In the case where the thermal transfer ink layer 62a is composed of three ink layers, it is preferred that the colorant is contained in the second ink layer, but the first or third ink layer can also contain a colorant.

The colorant may preferably be contained in a proportion in the range of 3–60%. Less than 3% results in a low transferred image density, and more than 60% results in a poor transfer characteristic. The above range of colorant content is also preferred with respect to the total ink layers even where the thermal transfer ink layer 62*a* is composed of three (or more) layers.

The thermal transfer ink layer 62*a* may preferably have a thickness in the range of 1 to 10 μ, further preferably 2 to 8 μ. In the case where the thermal transfer ink layer 62*a* has a three-layer structure it is preferred that the ink layers have a thickness in the above range, and each layer has a thickness of 0.1 to 4 μ. In view of these thicknesses, the ink layers may generally have a resin or polymer content of 50% or more, preferably 70% or more of the heat-fusible material, as a whole.

The transfer recording medium 62 for use in the present invention may be obtained by coating a support 62*b* with a coating liquid which forms a thermal transfer ink layer 62*a* by coating means (not shown), such as an applicator and a wire bar, and evaporating the solvent or dispersion medium to dry the coating. The coating liquid may for example be prepared by dissolving a water-soluble dye in an emulsion of the above-mentioned material, or by mixing an emulsion of the above-mentioned material with an aqueous dispersion of a pigment prepared by dispersing the pigment together with a water-soluble resin or a surfactant in an aqueous medium by dispersing means such as an attritor, and a sand mill. Alternatively, the coating liquid may also be prepared by dissolving or dispersing a dye in a solution or dispersion of the above-mentioned material, or by mixing a pigment with a solution or dispersion of the above-mentioned material, followed by dispersion with a dispersing means such as an attritor or a sand mill.

The transfer recording medium 62 used in the present invention can have any planar shape without restriction but is generally shaped in a form like that of a typewriter ribbon or a tape with a large width as used in line printers, etc. Also, for the purpose of color recording, it can be formed as a transfer recording medium 62 in which thermal transfer inks in several colors are applied in stripes or blocks.

The correction tape or ribbon 9 which can be used to correct a transferred image 8 obtained according to the present invention, may be formed by coating a support 9*b* with a heat-sensitive adhesive layer 9*a* (see FIG. 5). The support of the correction tape 9 may be formed from a similar material as that used for the transfer recording medium 62 as described above and may have a similar thickness as the support 62*b* for the transfer recording medium 62. Further, the support 62*b* can be coated with a heat-resistant protective layer 9C, or backing, similar to the support 62*b* for the transfer recording medium 62.

The heat-sensitive adhesive layer 9*a* may comprise one or more materials, such as a homopolymer or copolymer of olefin, such as polyethylene, polypropylene, polyisobutylene, ethylene-vinyl acetate copolymer, ethylene-vinyl acetate copolymer, and ethylene-ethyl acrylate copolymer, or derivatives of these; heat-sensitive adhesives of polyamide, polyester, polyurethane or acrylic resin type; and styrene-type block copolymers, such as styrene-isobutylene copolymer, styrene-butadiene copolymer, and styrene-ethylene-butylene copolymer. Further, it is also possible to add a tackifier, such as alicyclic hydrocarbon, terpene, or rosin; a filler, such as tale or calcium carbonate, and a stabilizer such as an antioxidant.

The heat-sensitive adhesive layer 9*a* may preferably have a thickness of 1–20 μ. A thickness below 1 μ fails to provide uniform adhesion with a recorded image 8, and a thickness exceeding 20 μ is not desirable because of inferior heat conduction from the heat source.

The heat-sensitive adhesive layer 9*a* is composed not to have an adhesiveness at room temperature but to have an adhesiveness only on when heated. It is particularly preferred that the adhesive layer 9*a* is composed to have an adhesiveness selectively when heated to 60° C. or above by formulating the above materials. If the adhesive layer 9*a* has an adhesiveness at room temperature, the cohesive force of the adhesive is lowered depending on the environmental conditions surrounding the recording apparatus.

As described above, according to the thermal transfer recording method of the present invention, the thermal transfer ink does not excessively permeate into the record paper 1, so that recorded images 8 with a uniform image density can be formed even on rough paper 1. The thus formed recorded image 8 can be corrected by lifting-off when necessary.

Further, according to the present invention, the temperature of the thermal transfer ink layer 62*a* gently decreases after the termination of the heating by the thermal head 61, so that there is formed an increased difference in film strength between the heated portion and the non-heated portion for recording and a recorded image 8 with good edge sharpness can be obtained.

Further, in the method of the present invention, the thermal transfer recording medium 62 is always held at a temperature above the environmental temperature, so that the performances Of the transfer recording medium 62 is not affected by a change in environmental temperature and excellent recorded images 8 can be obtained stably.

Further, according to the present invention, the heat energy applied to the heating elements 61*b* of the thermal head 61 is decreased, so that the life of the thermal head 61 can be prolonged.

Hereinbelow, the present invention will be explained in further detail with reference to Examples.

EXAMPLE 1

| | |
|---|---|
| <First ink layer> | |
| Ethylene-vinyl acetate copolymer emulsion (MI (melt index): 6, vinyl acetate content: 28%) | 3.5 parts |
| Ethylene-vinyl acetate copolymer emulsion (MI: 15, vinyl acetate content: 28%) | 2 parts |
| Ethylene-methacrylic acid-styrene copolymer emulsion | 3.5 parts |
| Carbon black aqueous dispersion | 1 part |
| <Second ink layer> | |
| Ethylene-vinyl acetate copolymer emulsion (MI: 6, vinyl acetate content: 28%) | 4 parts |
| Oxidized polyethylene emulsion (dropping point (ASTM D-3109-77) = 140° C.) | 2 parts |
| Vinyl acetate-ethylene copolymer emulsion (Vinyl acetate content: 86%) | 1 part |
| Carbon black aqueous emulsion | 3 parts |
| <Third ink layer> | |
| Oxidized polyethylene emulsion (dropping point = 103° C.) | |

(The amounts of emulsion and aqueous dispersion for providing an ink formulation are all expressed based on their solid contents, and the physical properties and content of a component are those obtained with respect to a base resin concerned. The same expressions are also used in the other Examples.)

The inks for the above mentioned ink layers were respectively prepared by sufficiently mixing the above ingredients.

The first ink was applied by means of an applicator on a 6 μ-thick PET (polyethylene tere-phthalate)-film as a support and dried to form a first ink layer at a coating rate of 1 g/m$^2$ (on a dry basis. The same as in the following). The second ink was similarly applied on the first ink layer and dried to form a second ink layer at a coating rate of 1.2 g/m$^2$. Further, the third ink was applied on the second ink layer and dried to form a third ink layer at a coating rate of 1.4 g/m$^2$ whereby a thermal transfer recording medium 2 according to the present invention was obtained.

Then, the transfer recording medium 2 was slit into an 8 mm-wide ribbon and used for recording by means of a thermal printer as shown in FIG. 1. A substrate 3*a* of a thermal head 3 was controlled at a temperature of 50° C.±3° C., and heating elements 3*b* arranged at a density of 240 dots (elements) /mm were energized by a power of 0.36 W/dot for a duration of 0.8 msec while moving the thermal head 3 at a speed of 50 mm/sec. In this manner, thermal transfer recording was effected on two record papers having Bekk smoothness of 2 sec and 100 sec, respectively. The results are shown in Table 1 appearing hereinafter.

Separately, a correction tape was prepared by coating a 6 μ-thick PET film with ethylene-vinyl acetate emulsion at a coating rate of 4 g/m$^2$ and then with a colloidal silica layer at 0.2 g/m$^2$. The resultant correction tape was used to remove the recorded image 8 obtained above in the manner explained with reference to FIG. 5. At this time, each heating element 3*b* of the thermal head 3 was supplied with a power of 0.12 W for a duration of 1 msec while moving the thermal head 3 at a speed of 20 mm/sec. By this operation, the recorded image 8 could be removed with substantially no trace left. The result of the correction is also shown in the Table 1.

Figure 11A:
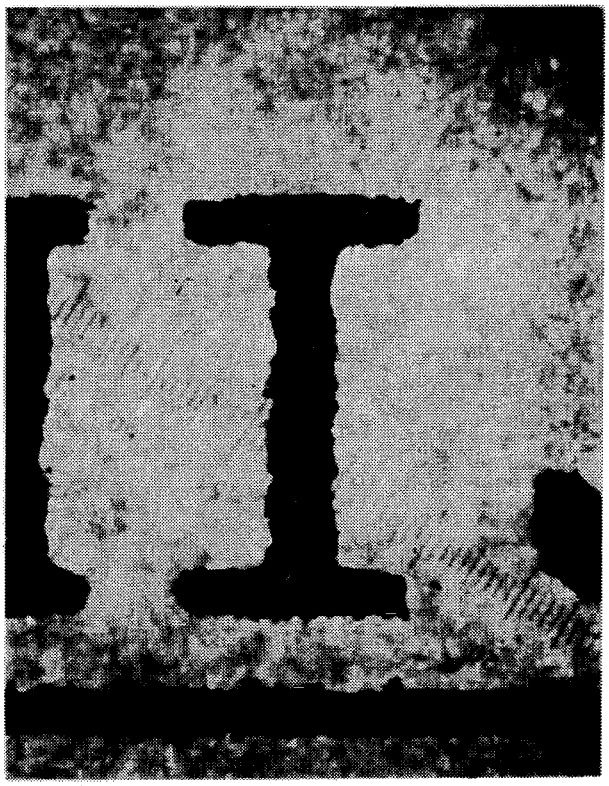
FIGS. 11A and 11B are enlarged photographs (magnification of 20) of a letter image and a letter image after peeling-off by a correction tape, respectively, obtained in Example 1.
Figure 11B:
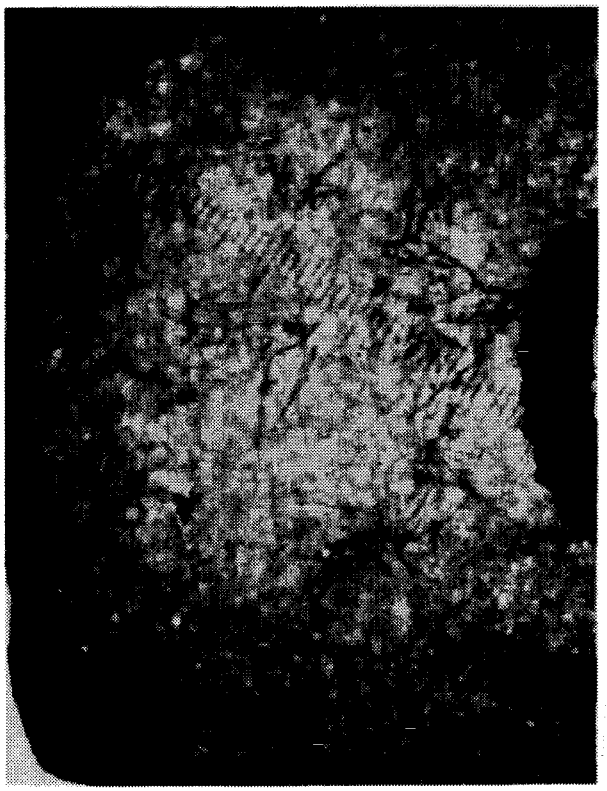

FIG. 11A is an enlarged photograph (×20) of a letter image "I" after recording and FIG. 11B is an enlarged photograph (×20) of a letter image "B" after correction, respectively obtained in the above recording and correcting operations on a record paper 1 with a Bekk smoothness of 2 sec.

The above recorded image 8 was also corrected by using Quiet Writer and a correction tape for Quiet writer available from IBM Inc. Also in this case, the recorded image 8 could be removed with substantially no trace.

Figure 9B:
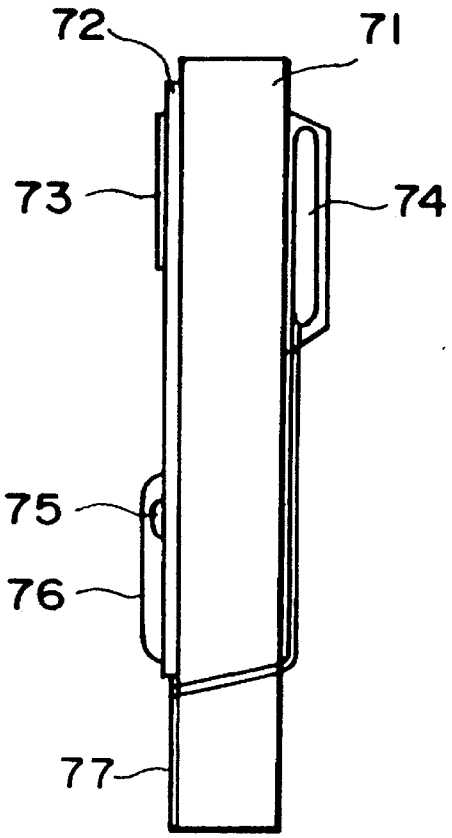
FIGS. 9A and 9B are a front view and a side view, respectively, of the thermal head.
Figure 9A:
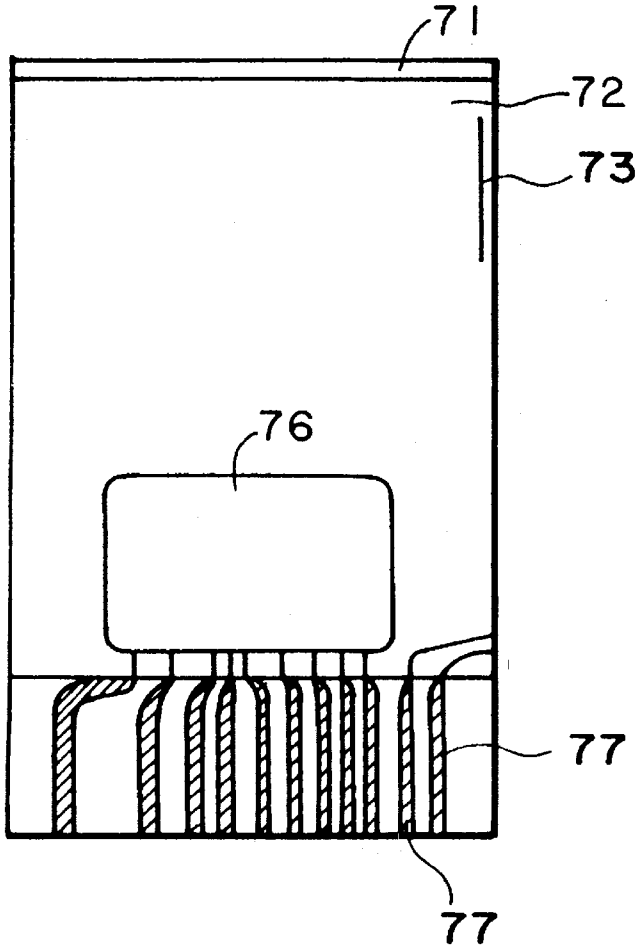
Figure 10:
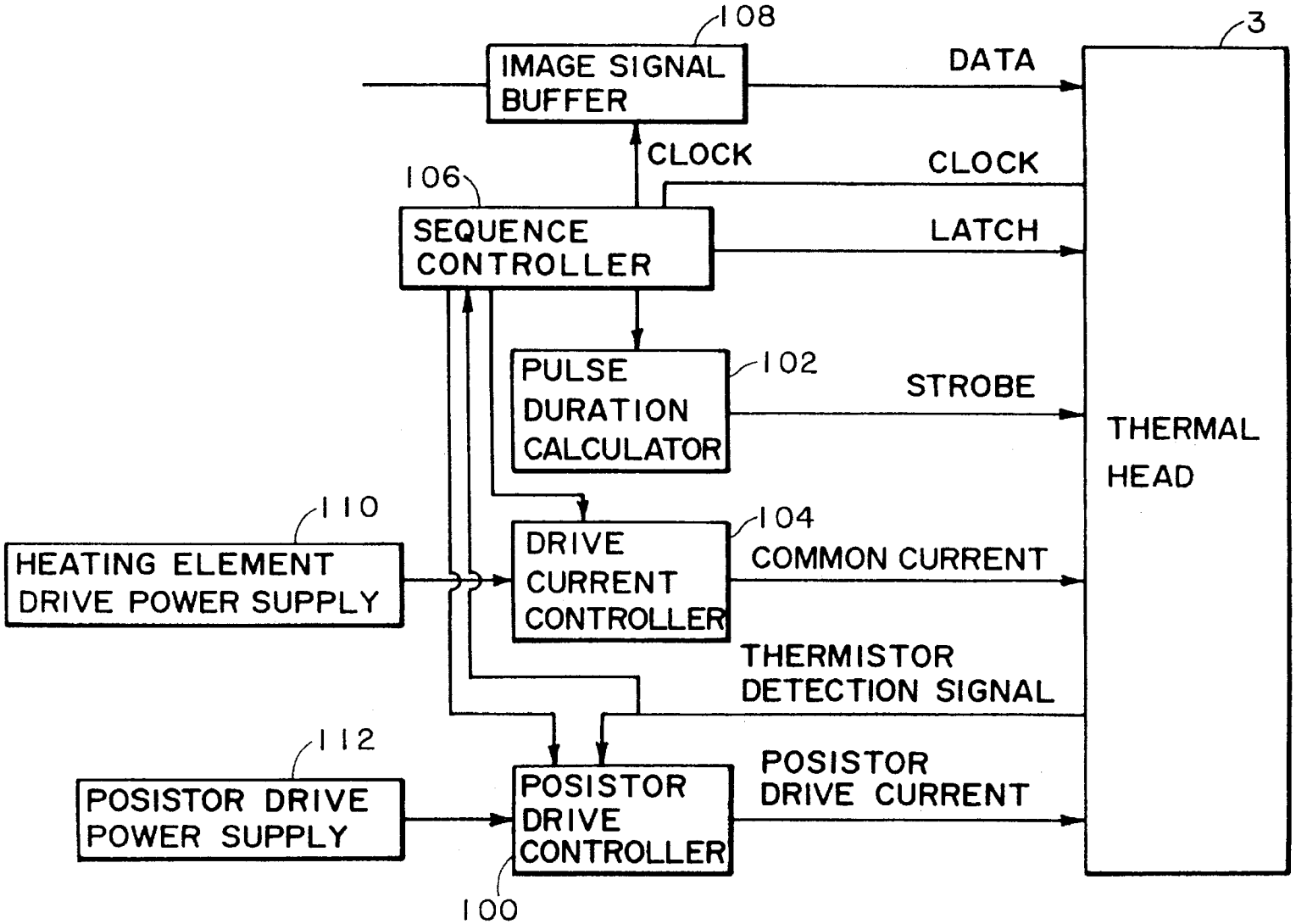
FIG. 10 is a block diagram of a drive circuit of a thermal head.

A more detailed front view and a side view of the thermal head used in this Example is shown in FIGS. 9A and 9B. FIG. 10 is a block diagram of the driving circuit for the thermal head used.

Onto an aluminum substrate 71, a ceramic plate 72 provided with electrodes (not shown) was bonded. An array of heating elements 73 was disposed at about 200 μ from the edge. A posistor 74 having a saturation temperature of 60° C. was affixed to the aluminum substrate 71 with a resin-type adhesive. Further, a thermistor 75 was affixed on the side provided with the heating element array 73 of the aluminum substrate 71 and sealed up together with a driver IC 76 with a resin.

When a voltage of 20 V was applied to the posistor 74 through external connection terminals 77, the temperature detected by the thermistor 75 reached 45° C. in about 20 sec. At this time, the surface temperature of the ceramic plate 71 in the neighborhood of the heating element array was about 50° C. A posistor drive controller 100 (FIG. 10), driven by a posistor drive power supply was operated to effect ON-OFF control so as to control the temperature detected by the thermistor 75 at 45° C.±2° C. In the case where the temperature was increased even when the current to the posistor 74 was continually off, thickening of an image occurred. In such a case, a pulse duration calculator 102 (FIG. 10) was actuated to decrease the duration of a pulse for driving the heating elements 73, so as to effect compensation. The pulse duration calculator 102 receives a signal from a sequence controller 106, which also sends signals to the image signal buffer 108, the drive current controller 104 (which receives power from the heating element driver power supply 110), and the posistor drive controller 100.

EXAMPLE 2

| | |
|---|---|
| <First ink layer> | |
| Ethylene-vinyl acetate copolymer emulsion (MI: 15, vinyl acetate content: 28%) | 4 parts |
| Ethylene-methacrylic acid-styrene copolymer emulsion | 3 parts |
| Vinyl acetate-ethylene copolymer emulsion (vinyl acetate content: 28%) | 2 parts |
| (Carbon black aqueous dispersion | 1 part |
| <Second ink layer> | |
| Ethylene-vinyl acetate copolymer emulsion (MI: 15, vinyl acetate content: 28%) | 4 parts |
| Oxidized polyethylene emulsion (dropping point = 140° C.) | 2 parts |
| Vinyl acetate-ethylene copolymer emulsion (vinyl acetate content: 86%) | 1 part |
| Carbon black aqueous emulsion | 3 parts |
| <Third ink layer> | |
| Oxidized polyethylene emulsion (dropping point = 103° C.) | |

By using the above compositions of inks, a first ink layer at 0.8 g/m$^2$, a second ink layer at 1.1g/m$^2$ and a third ink layer at 1.9 g/m$^2$, were successively formed to prepare a thermal transfer recording medium 2 according to the present invention.

The transfer recording medium 2 was slit into a ribbon and used for recording in the same manner as in Example 1. Further, the recorded image was corrected in the same manner as in Example 1 whereby correction was effected with substantially no trace left.

The results of the recording and the correction are also shown in Table 1.

The correction was successfully effected with substantially no trace by using Quiet Writer and a correction tape therefor available from IBM Inc.

COMPARATIVE EXAMPLE 1

Example 1 was repeated except that the recording was effected without heating the substrate 3*a* of the thermal head 3 by the heater 7. Correspondingly, the energy applied to the heating elements 3*b* was increased by about 15% so as to avoid noticeable lack of recorded images 8 because of insufficient energy as was recognized in a case where the energy applied to the heating elements 3*b* was the same as in Example 1.

After the recording, the recorded image 8 was corrected in the same manner as in Example 1. The results of recording and correction are shown in Table 1.

Figure 12A:
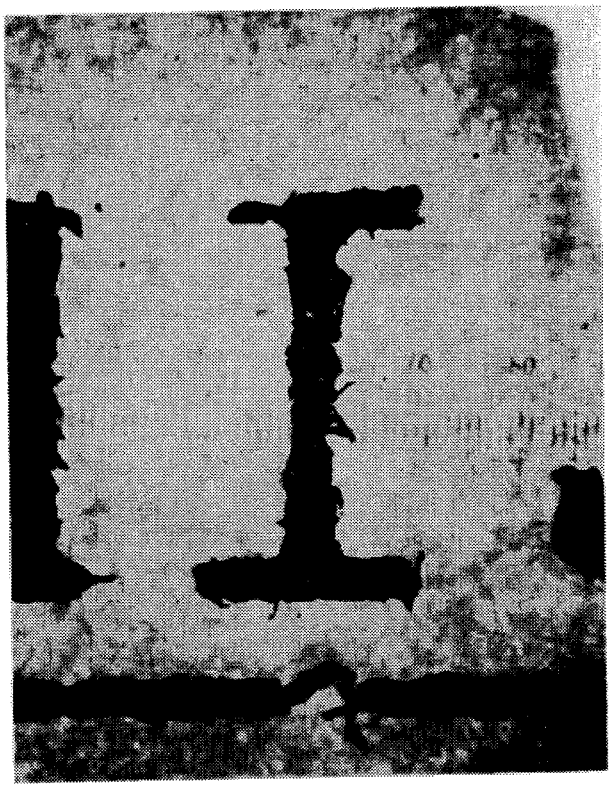
FIGS. 12A and 12B are enlarged photographs (magnification of 20) of a letter image and a letter image after peeling-off by a correction tape, respectively, obtained in Comparative Example 1.
Figure 12B:
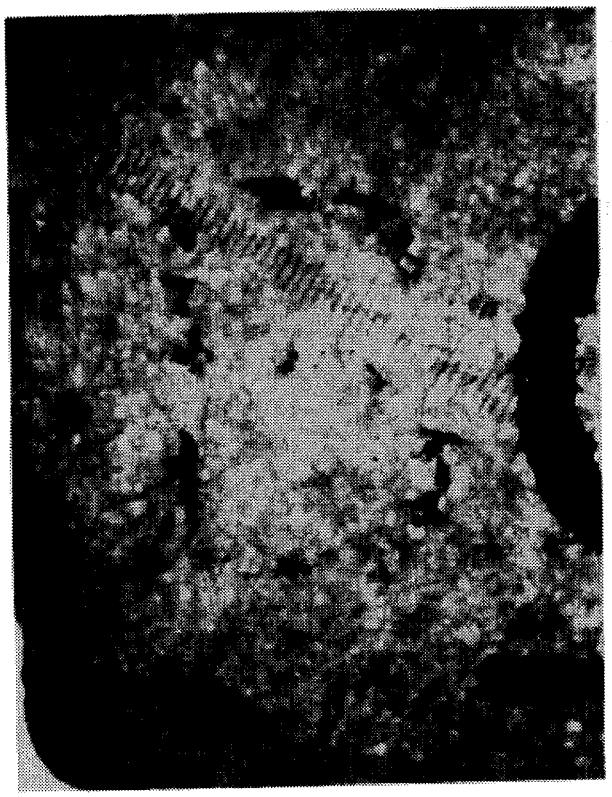

FIG. 12A is an enlarged photograph (×20) of a letter image "I" after recording and FIG. 12B is an enlarged photograph (×20) of a letter image "B" after correction, respectively obtained in the above recording and correcting operations on a record paper 1 with a Bekk smoothness of 2 sec.

COMPARATIVE EXAMPLE 2

Example 1 was repeated except that the recording was effected without heating the substrate 3*a* of the thermal head 3 by the heater 7. The temperature of the substrate 3*a* was 28±5° C. at this time. Correspondingly, the energy applied to the heating elements 3*b* was increased by about 15%.

After the recording, the recorded image 8 was corrected in the same manner as in Example 2. The results of recording and correction are shown in Table 1.

COMPARATIVE EXAMPLE 3

As a representative of the conventional thermal transfer recording medium, a transfer recording medium having a thermal transfer ink layer comprised predominantly of wax was prepared and used for recording.

The composition of the thermal transfer ink layer was as follows.

| | |
|---|---|
| Paraffin wax (softening point; 65° C.) | 40 parts |
| Ethylene-vinyl acetate copolymer (MI: 150, vinyl acetate content: 28%) | 22 parts |
| Carnauba wax | 20 parts |
| Carbon black | 18 parts |

Figure 13A:
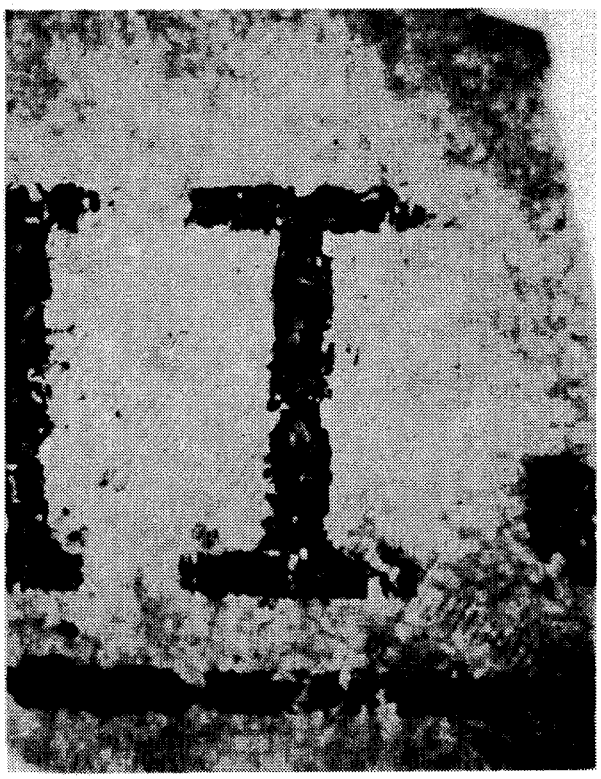
FIGS. 13A and 13B are each enlarged photograph (magnification of 20) of a letter image obtained in Comparative Example 3.
Figure 13B:
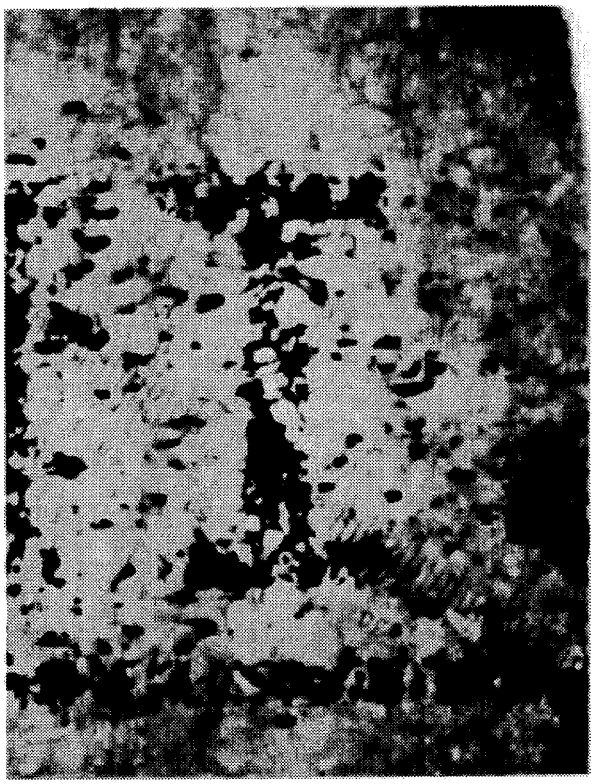

The transfer recording medium was prepared by coating a 6 μ-thick PET film with a 5 μ-thick thermal transfer ink layer of the above composition. The recording was effected by using the same recording apparatus as used in Example 1. In the recording, the heating elements 3*b* were energized by a power of 0.36 W/dot for a duration of 0.8 msec. A record paper 1 with a Bekk smoothness of 2 sec was used. The recording results are shown in FIGS. 13A and 13B which are respectively enlarged photographs (×20) of a letter image "I". FIG. 13A. is a result of the recording which was effected without heating the substrate 3*a* of the thermal head 3 by the heater 7. The temperature detected by the thermistor 75 was 28±5° C. at that time. FIG. 13B is a result of the recording which was effected while heating the substrate 3*a* of the thermal head 3 by the heater 7. The temperature detected by the thermistor 75 was 50±3° C.

The recorded image obtained without heating the substrate 3*a* was poor in coverage and the edge thereof was remarkably zigzag, thus being of a low quality, as shown in FIG. 13A. On the other hand, the recorded image obtained while heating the substrate 3*a* caused ground soiling as shown in FIG. 13B and was of an even lower quality than that shown in FIG. 13A.

Figure 14A:
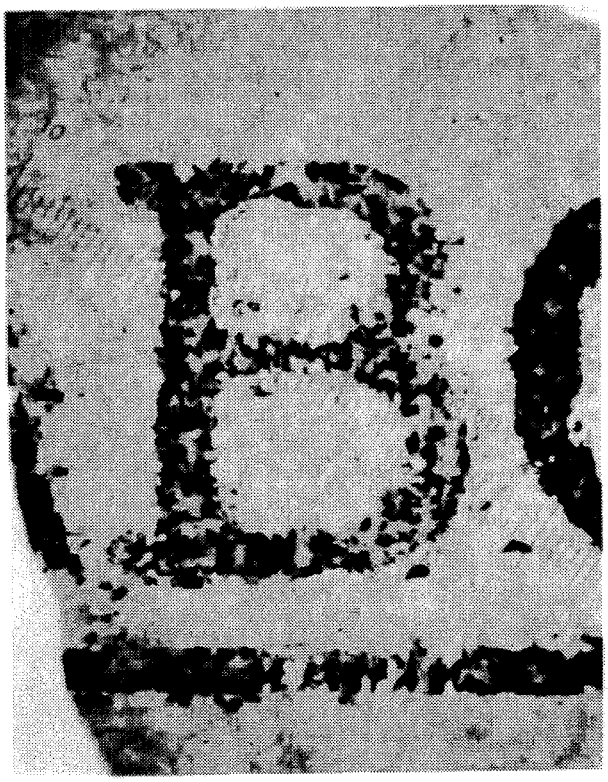
FIGS. 14A and 14B are each an enlarged photograph (magnification of 20) of a letter image after peeling-off by a correction tape in Comparative Example 3.
Figure 14B:
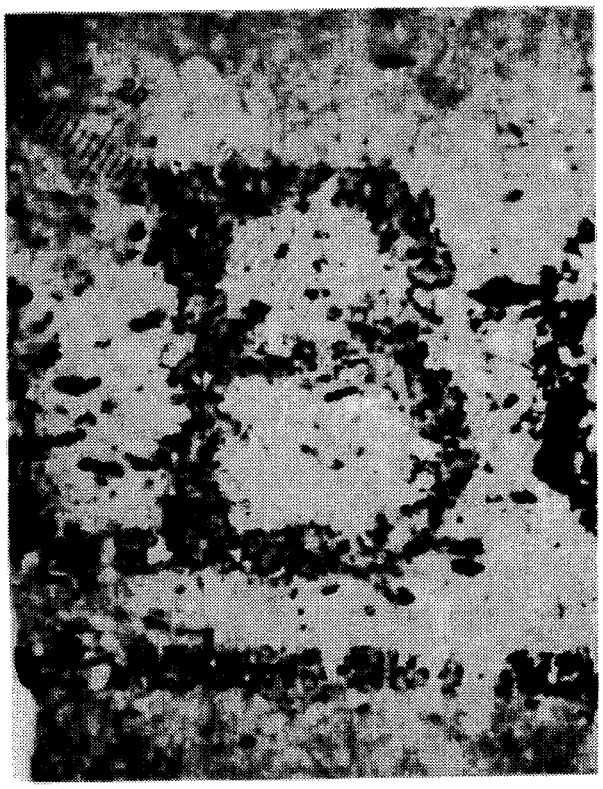

Further, these recorded images were peeled in the same manner as in Example 1. The results of the correcting operations are shown in FIGS. 14A and 14B which are respectively enlarged views (×20). FIG. 14A is a result of the correcting operation applied to a letter image "B" corresponding to the one shown in FIG. 13A obtained without heating the substrate 3A. FIG. 14B is a result of the correcting operation applied to a letter image "B" corresponding to the one shown in FIG. 13B obtained while heating the substrate 3A. As is apparent from the FIGS. 14A and 14B, the recorded image could not be clearly peeled in any case, thus being impossible to correct.

TABLE 1

| Evaluation of recorded images | Example 1 | Example 2 | Comparative Example 1 | Comparative Example 2 |
|---|---|---|---|---|
| On Bekk smoothness of 2 sec | | | | |
| Edge sharpness | o | o | x | x |
| Lacking of images | o | o | x | o |
| On Bekk smoothness of 100 sec | | | | |
| Edge sharpness | o | o | o | o |
| Lacking of images | o | o | o | o |
| Evaluation of correction | — | — | — | — |
| On Bekk smoothness of 2 sec | o | o | x | x |
| On Bekk smoothness of 100 sec | o | o | x | x |

o: Good
x: Poor

As summarized in Table 1 above, the thermal transfer recording method according to the present invention provides transfer recorded images which are free of missing portions, have good edge sharpnesses on both rough paper and smooth paper, and can be easily corrected without leaving traces.

On the other hand, Comparative Examples 1 and 2 provided recorded images with inferior quality and correctability.

What is claimed is:

1. In a thermal transfer recording and correction method, comprising the steps of:

providing a thermal transfer recording medium comprising a thermal transfer ink layer having a transfer initiation temperature and disposed on a support; providing a thermal head including a substrate and a plurality of heat generating elements for recording disposed on said substrate placing the thermal transfer recording medium in contact with a transfer-receiving medium so that the thermal transfer ink layer contacts the transfer-receiving medium; energizing the heat generating elements corresponding to a given recording image signal so that said heat generating elements heat the thermal transfer ink layer of the thermal transfer recording medium in a pattern; separating the thermal transfer recording medium from the transfer-receiving medium to leave a recorded image of the heated thermal transfer ink layer on the transfer-receiving medium corresponding to the given recording image signal; and peeling an erroneous image, if any, left on the transfer-receiving medium from the transfer-receiving medium to at least substantially remove the erroneous image from the transfer-receiving medium, the improvement wherein:

said thermal head is further provided with a preheating means for preheating the thermal head and with a temperature detecting element for detecting a temperature of said substrate; and the thermal transfer ink layer is preheated by the thermal head preheated by the preheating means and, while at an elevated temperature due to the preheating, further heated by said energizing of the heat generating elements, so that a resultant heated region of the thermal transfer ink layer substantially coincident with a region occupied by the energized heat generating elements has a maximum temperature and a minimum temperature which are both within a suppressed temperature range of from the transfer initiation temperature to a temperature about 40° C. higher than the transfer initiation temperature, whereby a peelability of the erroneous image is improved.

2. A method according to claim 1, wherein the thermal transfer ink layer is preheated so as to assume a temperature of 40°–50° C.

3. A method according to claim 1, wherein a period from a completion of the energizing of said heat generating elements up to the separating of the thermal transfer recording medium from the transfer-receiving medium is 0.2–80 msec.

4. A method according to claim 3, wherein the period from the completion of the energizing of said heat generating elements up to the separating of the thermal transfer recording medium from the transfer-receiving medium is 0.5–30 msec.

* * * * *

UNITED STATES PATENT AND TRADEMARK OFFICE

CERTIFICATE OF CORRECTION

PATENT NO. : 5,529,408

DATED : June 25, 1996

INVENTOR(S) : HARUHIKO MORIGUCHI ET AL.

It is certified that error appears in the above-identified patent and that said Letters Patent is hereby corrected as shown below:

AT SHEET 5, FIGURE 7C

"ELEHENT" should read --ELEMENT--.

COLUMN 2

Line 21, "3°-60°C" should read --35°-60°C--.

COLUMN 4

Line 8, "9C see" should read --9 (see--;
Line 30, "then" should read --when--.

COLUMN 8

Line 7, "layer 9C" should read --layer 9c--.

COLUMN 9

Line 32, "a" should be deleted;
Line 60, "5-10μin" should read --5-10 μ in--.

COLUMN 10

Line 47, "layer 662a" should read --layer 62a--.

UNITED STATES PATENT AND TRADEMARK OFFICE

CERTIFICATE OF CORRECTION

PATENT NO. : 5,529,408

DATED : June 25, 1996

INVENTOR(S) : HARUHIKO MORIGUCHI ET AL.

It is certified that error appears in the above-identified patent and that said Letters Patent is hereby corrected as shown below:

COLUMN 11

Line 64, "tale" should read --talc--.

COLUMN 12

Line 6, "on" should be deleted;
Line 31, "Of" should read --of--.

COLUMN 13

Line 8, "tere-phthalate)-film" should read --terephthalate) film--.

UNITED STATES PATENT AND TRADEMARK OFFICE

CERTIFICATE OF CORRECTION

PATENT NO. : 5,529,408

DATED : June 25, 1996

INVENTOR(S) : HARUHIKO MORIGUCHI ET AL.

It is certified that error appears in the above-identified patent and that said Letters Patent is hereby corrected as shown below:

COLUMN 14

Line 3, "supply" should read --supply 112,--.

Signed and Sealed this

Third Day of December, 1996

Bruce Lehman

*Attest:*

BRUCE LEHMAN

*Attesting Officer*

*Commissioner of Patents and Trademarks*